US008550166B2

(12) United States Patent
Xu et al.

(10) Patent No.: US 8,550,166 B2
(45) Date of Patent: Oct. 8, 2013

(54) SELF-ADJUSTING IN-FLOW CONTROL DEVICE

(75) Inventors: Richard Yingqing Xu, Tomball, TX (US); Tianping Huang, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 234 days.

(21) Appl. No.: 12/506,810

(22) Filed: Jul. 21, 2009

(65) Prior Publication Data

US 2011/0017470 A1 Jan. 27, 2011

(51) Int. Cl.
*E21B 43/08* (2006.01)
*E21B 43/14* (2006.01)
*E21B 34/06* (2006.01)

(52) U.S. Cl.
USPC ..... 166/326; 166/373; 166/263; 166/306

(58) Field of Classification Search
USPC ..... 166/373, 386, 177.3, 191, 202, 326, 166/319, 320, 227–236, 269, 263, 305.1, 166/250.1, 298, 308.1, 177.5; 137/517, 521, 137/588; 138/46
See application file for complete search history.

(56) References Cited

U.S. PATENT DOCUMENTS

| | | | | |
|---|---|---|---|---|
| 1,362,552 | A | 12/1920 | Alexander et al. | |
| 1,649,524 | A | 11/1927 | Hammond | |
| 1,915,867 | A | 6/1933 | Penick | |
| 1,984,741 | A | 12/1934 | Harrington | |
| 2,119,563 | A | 3/1937 | Wells | |
| 2,089,477 | A | 8/1937 | Halbert | |
| 2,214,064 | A | 9/1940 | Niles | |
| 2,257,523 | A | 1/1941 | Combs | |
| 2,412,841 | A | 12/1946 | Spangler | |
| 2,642,889 | A * | 6/1953 | Cummings | 137/155 |
| 2,762,437 | A | 1/1955 | Egan et al. | |
| 2,810,352 | A | 10/1957 | Tumilson | |
| 2,942,668 | A | 11/1957 | Maly et al. | |
| 2,814,947 | A | 12/1957 | Stegemeier et al. | |

(Continued)

FOREIGN PATENT DOCUMENTS

| | | |
|---|---|---|
| CN | 1385594 | 12/2002 |
| GB | 1492345 | 11/1977 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Kenneth L Thompson
(74) *Attorney, Agent, or Firm* — Mossman, Kumar & Tyler PC

(57) ABSTRACT

Devices, systems and related methods control a flow of a fluid between a wellbore tubular and a formation using a flow control device having a flow space formed therein; and a flow control element positioned in flow space. The flow control element may be configured to flex between a first radial position and a second radial position to in response to a pressure differential along the flow space.

18 Claims, 4 Drawing Sheets

(56) References Cited

U.S. PATENT DOCUMENTS 2,875,775 A * 3/1959 Cummings ..... 137/155
2,942,541 A 7/1960 Maly et al.
3,326,291 A 6/1967 Zandmer
3,385,367 A 5/1968 Kollsman
3,419,089 A 12/1968 Venghiattis
3,428,128 A * 2/1969 Jones ..... 166/278
3,451,477 A 6/1969 Kelley
3,595,315 A * 7/1971 Alley ..... 166/326
3,637,010 A * 1/1972 Maly et al. ..... 166/51
3,675,714 A 7/1972 Thompson
3,692,064 A 9/1972 Hohnerlein et al.
3,739,845 A 6/1973 Berry et al.
3,741,301 A * 6/1973 Maly et al. ..... 166/191
3,750,710 A * 8/1973 Hayner ..... 138/40
3,791,444 A 2/1974 Hickey
3,802,500 A * 4/1974 Schmidt ..... 166/51
3,876,471 A 4/1975 Jones
3,918,523 A 11/1975 Stuber
3,951,338 A 4/1976 Genna
3,975,651 A 8/1976 Griffiths
4,078,810 A * 3/1978 Arendt ..... 277/336
4,153,757 A 5/1979 Clark, III
4,173,255 A 11/1979 Kramer
4,187,909 A 2/1980 Erbstoesser
4,227,573 A * 10/1980 Pearce et al. ..... 166/153
4,248,302 A 2/1981 Churchman
4,250,907 A 2/1981 Struckman et al.
4,257,650 A 3/1981 Allen
4,287,952 A 9/1981 Erbstoesser
4,356,865 A * 11/1982 Appel et al. ..... 166/153
4,377,968 A * 3/1983 Gerry ..... 454/213
4,434,849 A 3/1984 Allen
4,491,186 A 1/1985 Alder
4,497,714 A 2/1985 Harris
4,544,099 A * 10/1985 Norris ..... 239/271
4,552,218 A 11/1985 Ross et al.
4,614,303 A 9/1986 Moseley, Jr. et al.
4,649,996 A 3/1987 Kojicic
4,974,674 A 12/1990 Wells
4,998,585 A 3/1991 Newcomer et al.
5,016,710 A 5/1991 Renard et al.
5,033,551 A * 7/1991 Grantom ..... 166/387
5,060,422 A * 10/1991 Horton ..... 49/489.1
5,132,903 A 7/1992 Sinclair
5,156,811 A 10/1992 White
5,333,684 A 8/1994 Walter et al.
5,337,821 A 8/1994 Peterson
5,431,346 A 7/1995 Sinaisky
5,435,393 A 7/1995 Brekke et al.
5,435,395 A 7/1995 Connell
5,439,966 A 8/1995 Graham et al.
5,586,213 A 12/1996 Bridges
5,597,042 A 1/1997 Tubel et al.
5,609,204 A 3/1997 Rebardi et al.
5,673,751 A 10/1997 Head et al.
5,803,179 A 9/1998 Echols et al.
5,829,522 A 11/1998 Ross et al.
5,831,156 A 11/1998 Mullins
5,839,508 A 11/1998 Tubel et al.
5,865,254 A * 2/1999 Huber et al. ..... 166/373
5,873,410 A 2/1999 Iato et al.
5,881,809 A 3/1999 Gillespie et al.
5,896,928 A 4/1999 Coon
5,982,801 A 11/1999 Deak
6,068,015 A 5/2000 Pringle
6,098,020 A 8/2000 Den Boer
6,112,815 A 9/2000 Boe
6,112,817 A 9/2000 Voll et al.
6,119,780 A 9/2000 Christmas
6,253,847 B1 7/2001 Stephenson
6,253,861 B1 7/2001 Charmichael et al.
6,273,194 B1 8/2001 Hiron et al.
6,305,470 B1 10/2001 Woie
6,338,363 B1 1/2002 Chen et al.
6,367,547 B1 4/2002 Towers
6,371,210 B1 4/2002 Bode et al.
6,419,021 B1 7/2002 George et al.
6,505,682 B2 1/2003 Brockman
6,516,888 B1 2/2003 Gunnarson et al.
6,581,682 B1 6/2003 Parent et al.
6,619,938 B2 * 9/2003 Woodruff ..... 418/142
6,622,794 B2 9/2003 Zisk, Jr.
6,679,324 B2 1/2004 Den Boer et al.
6,732,804 B2 * 5/2004 Hosie et al. ..... 166/373
6,786,285 B2 9/2004 Johnson et al.
6,799,638 B2 * 10/2004 Butterfield, Jr. ..... 166/386
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
6,994,518 B2 * 2/2006 Simon et al. ..... 415/147
7,004,248 B2 * 2/2006 Hoffman et al. ..... 166/191
7,011,076 B1 3/2006 Weldon et al.
7,108,071 B2 * 9/2006 Freiheit et al. ..... 166/373
7,185,706 B2 3/2007 Freyer
7,290,606 B2 11/2007 Coronado et al.
7,316,245 B2 * 1/2008 Bivin ..... 138/37
7,322,412 B2 1/2008 Badalamenti et al.
7,325,616 B2 2/2008 Lopez De Cardenas
7,395,858 B2 7/2008 Barbosa et al.
7,409,999 B2 8/2008 Henrikson et al.
7,413,022 B2 8/2008 Broome et al.
7,469,743 B2 12/2008 Richards
7,481,244 B2 * 1/2009 Bivin ..... 138/37
7,673,678 B2 3/2010 MacDougall et al.
7,717,175 B2 * 5/2010 Chung et al. ..... 166/268
7,762,341 B2 * 7/2010 Hammer ..... 166/370
7,845,399 B2 * 12/2010 Sebree ..... 166/106
7,845,400 B2 * 12/2010 Smith et al. ..... 166/177.3
7,896,082 B2 * 3/2011 Lake et al. ..... 166/375
7,900,705 B2 * 3/2011 Patel ..... 166/319
2001/0024619 A1 * 9/2001 Woodruff ..... 418/142
2001/0045288 A1 * 11/2001 Allamon et al. ..... 166/373
2002/0020527 A1 2/2002 Kilaas et al.
2002/0144812 A1 * 10/2002 Smith, Jr. ..... 166/177.3
2003/0099539 A1 * 5/2003 Preinfalk et al. ..... 415/12
2003/0221834 A1 12/2003 Hess et al.
2004/0096316 A1 * 5/2004 Simon et al. ..... 415/151
2004/0144544 A1 * 7/2004 Freyer ..... 166/369
2004/0194971 A1 10/2004 Thomson
2005/0016732 A1 1/2005 Brannon et al.
2005/0126776 A1 6/2005 Russell
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0217849 A1 * 10/2005 Hilsman et al. ..... 166/285
2005/0217861 A1 * 10/2005 Misselbrook ..... 166/373
2005/0230120 A1 * 10/2005 Victor ..... 166/372
2005/0241835 A1 11/2005 Burris et al.
2006/0042798 A1 3/2006 Badalamenti et al.
2006/0048936 A1 3/2006 Fripp et al.
2006/0048942 A1 3/2006 Moen et al.
2006/0076150 A1 4/2006 Coronado et al.
2006/0086498 A1 4/2006 Wetzel et al.
2006/0108114 A1 5/2006 Johnson
2006/0175065 A1 8/2006 Ross
2006/0180320 A1 * 8/2006 Hilsman et al. ..... 166/387
2006/0185849 A1 8/2006 Edwards et al.
2006/0272814 A1 12/2006 Broome et al.
2006/0273876 A1 12/2006 Pachla et al.
2007/0012439 A1 * 1/2007 McGuire et al. ..... 166/202
2007/0012444 A1 1/2007 Horgan et al.
2007/0034385 A1 * 2/2007 Tips et al. ..... 166/386
2007/0039732 A1 * 2/2007 Dawson et al. ..... 166/270
2007/0039741 A1 2/2007 Hailey, Jr.
2007/0044962 A1 3/2007 Tibbles
2007/0131434 A1 6/2007 MacDougall et al.
2007/0144599 A1 * 6/2007 Bivin ..... 138/37
2007/0246210 A1 10/2007 Richards
2007/0246213 A1 10/2007 Hailey, Jr.

| | | | | |
|---|---|---|---|---|
| 2007/0246225 | A1 | 10/2007 | Hailey, Jr. et al. | |
| 2007/0246407 | A1 | 10/2007 | Richards et al. | |
| 2007/0272408 | A1 | 11/2007 | Zazovksy et al. | |
| 2008/0000539 | A1* | 1/2008 | Bivin | 138/46 |
| 2008/0035349 | A1 | 2/2008 | Richard | |
| 2008/0035350 | A1 | 2/2008 | Henriksen | |
| 2008/0053662 | A1 | 3/2008 | Williamson et al. | |
| 2008/0061510 | A1* | 3/2008 | Li et al. | 277/300 |
| 2008/0110614 | A1* | 5/2008 | Orban | 166/101 |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0203076 | A1* | 8/2008 | Gelbart | 219/201 |
| 2008/0236839 | A1 | 10/2008 | Oddie | |
| 2008/0236843 | A1 | 10/2008 | Scott et al. | |
| 2008/0283238 | A1 | 11/2008 | Richards et al. | |
| 2008/0296023 | A1 | 12/2008 | Willauer | |
| 2008/0314590 | A1 | 12/2008 | Patel | |
| 2009/0008078 | A1* | 1/2009 | Patel | 166/50 |
| 2009/0044955 | A1* | 2/2009 | King et al. | 166/374 |
| 2009/0133869 | A1 | 5/2009 | Clem | |
| 2009/0133874 | A1 | 5/2009 | Dale et al. | |
| 2009/0139727 | A1 | 6/2009 | Tanju et al. | |
| 2009/0205834 | A1 | 8/2009 | Garcia et al. | |
| 2009/0250132 | A1* | 10/2009 | Bivin et al. | 138/39 |
| 2010/0096140 | A1* | 4/2010 | Mack | 166/369 |
| 2010/0294508 | A1* | 11/2010 | Xu et al. | 166/373 |

FOREIGN PATENT DOCUMENTS

| | | | |
|---|---|---|---|
| GB | 2341405 | | 12/2007 |
| JP | 59089383 | | 6/1984 |
| SU | 1335677 | A | 9/1987 |
| WO | WO 94/03743 | | 2/1994 |
| WO | WO 00/79097 | | 5/2000 |
| WO | WO 01/65063 | | 2/2001 |
| WO | WO 01/77485 | | 3/2001 |
| WO | WO02/075110 | | 9/2002 |
| WO | WO2004/018833 | A1 | 3/2004 |
| WO | WO2006/015277 | | 2/2006 |
| WO | WO2008/070674 | A1 | 6/2008 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

* cited by examiner

SELF-ADJUSTING IN-FLOW CONTROL DEVICE

CROSS-REFERENCE TO RELATED APPLICATION

None

BACKGROUND OF THE DISCLOSURE

1. Field of the Disclosure

The disclosure relates generally to systems and methods for selective control of fluid flow between a wellbore tubular such as a production string and a subterranean formation.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. Fluid from each production zone entering the wellbore is drawn into a tubing that runs to the surface. It is desirable to have substantially even drainage along the production zone. Uneven drainage may result in undesirable conditions such as an invasive gas cone and/or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil. Accordingly, it may be desired to provide controlled drainage across a production zone and/or the ability to selectively close off or reduce in-flow within production zones experiencing an undesirable influx of water and/or gas. Additionally, it may be desired to inject a fluid into the formation in order to enhance production rates or drainage patterns.

The present disclosure addresses these and other needs of the prior art.

SUMMARY OF THE DISCLOSURE

In aspects, the present disclosure provides an apparatus for controlling a flow of a fluid between a wellbore tubular and a formation. The apparatus may include a flow control device having a flow space formed therein; and a flow control element positioned in the flow space. The flow control element may be configured to flex between a first radial position and a second radial position in response to a change in a pressure differential along the flow space.

In aspects, the present disclosure also provides a method for controlling a flow of a fluid between a wellbore tubular and a formation. The method may include controlling fluid flow in a flow control device along the wellbore tubular by using a flow control element configured to flex between a first radial position and a second radial position in response to a change in a pressure differential in the flow control device.

In still further aspects, the present disclosure also provides a system for controlling a flow of a fluid between a wellbore tubular and a formation. The system may include a plurality of flow control devices positioned along the wellbore tubular, wherein each flow control device has a flow space formed therein; and a flow control element positioned in each flow space, each flow control element being configured to flex between a first radial position and a second radial position in response to a change in a pressure differential along the flow space.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE DISCLOSURE

Figure 1:
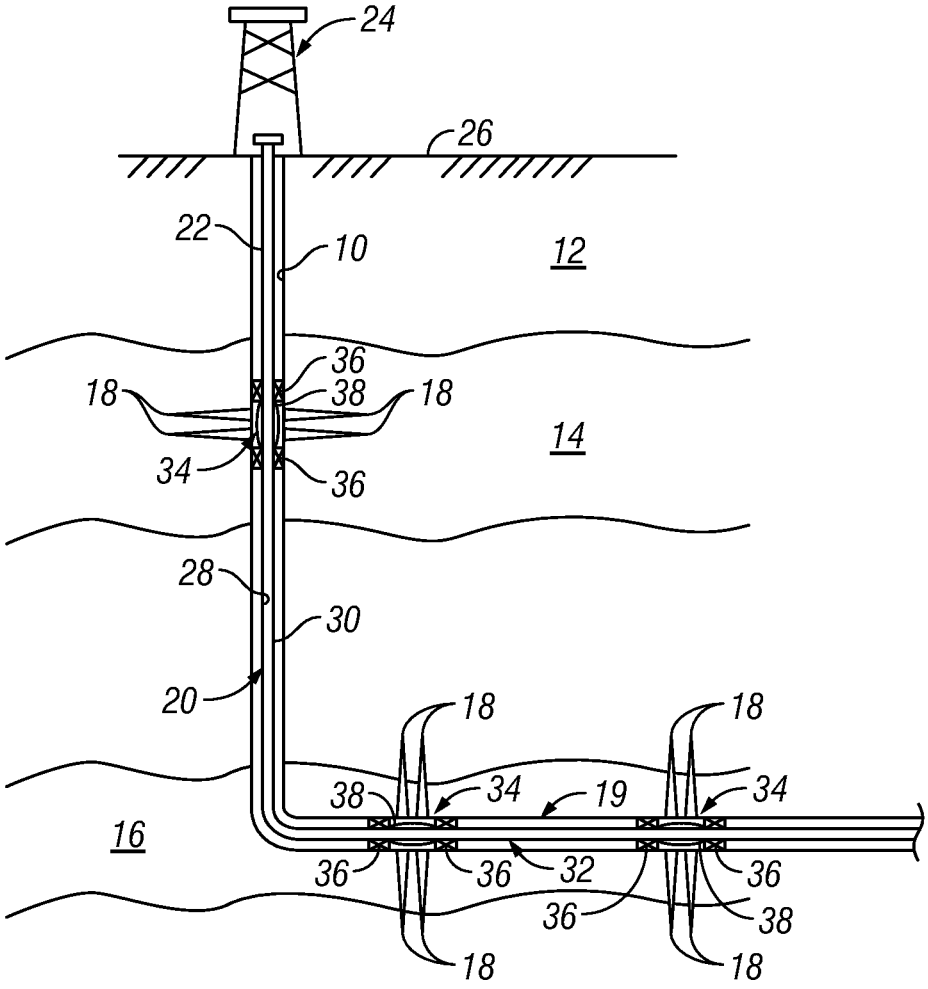
FIG. 1 is a schematic elevation view of an exemplary multi-zonal wellbore and production assembly which incorporates an in-flow control system in accordance with one embodiment of the present disclosure.

The present disclosure relates to devices and methods for controlling a flow of fluid in a well. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 1, there may, in fact, be a large number of such production devices arranged in serial fashion along the horizontal portion 32.

Each production device 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. In accordance with embodiments of the present disclosure, the production control device 38 may have a number of alternative constructions that ensure selective operation and controlled fluid flow therethrough.

Figure 2:
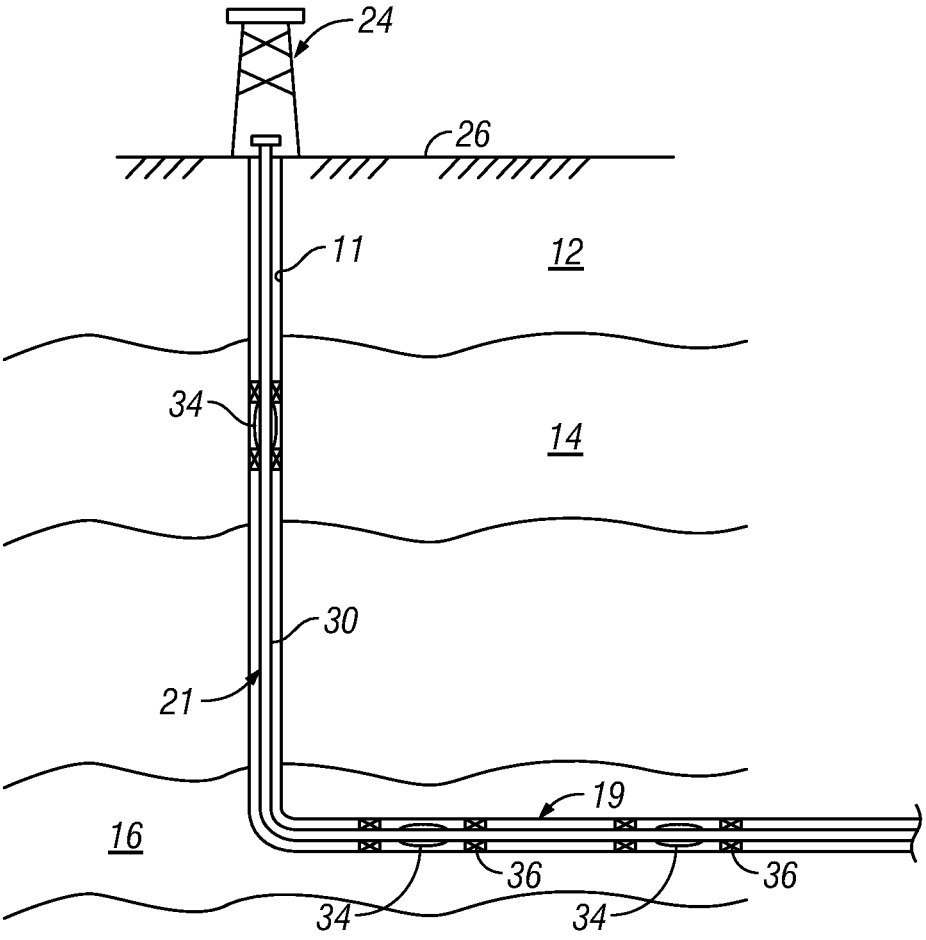
FIG. 2 is a schematic elevation view of an exemplary open hole production assembly which incorporates an in-flow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and open hole packers 36 may be used to isolate the production control devices 38. The nature of the production control device is such that the fluid flow is directed from the formation 16 directly to the nearest production device 34, hence resulting in a balanced flow. In some instances, packers maybe omitted from the open hole completion.

Figure 3:
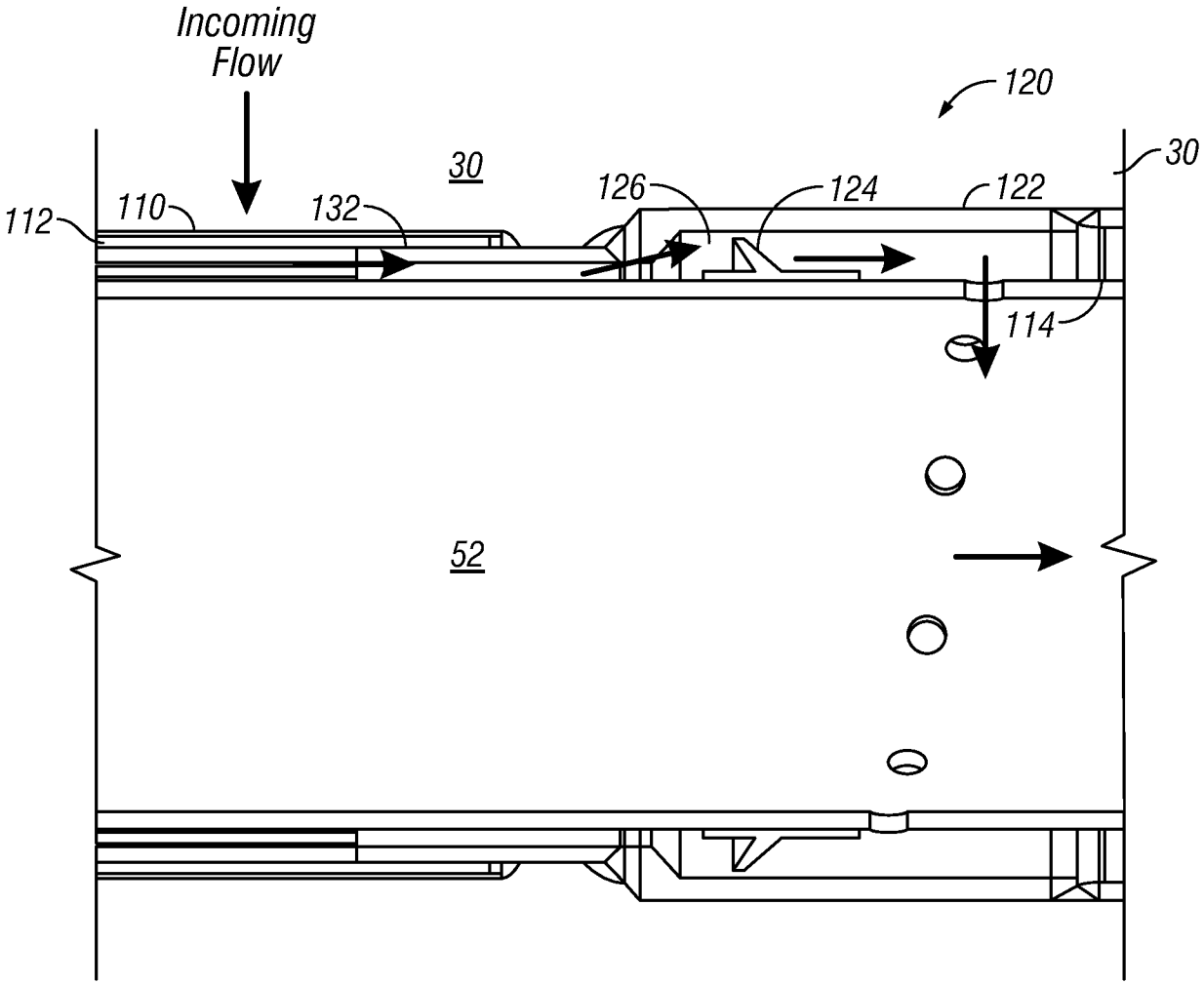
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a production string, or "in-flow" and/or the control of flow from the production string into the reservoir, or "injection." The control devices 100 can be distributed along a section of a production well to provide fluid control and/or injection at multiple locations. Exemplary production control devices are discussed herein below.

In one embodiment, the production control device 100 includes a particulate control device 110 for reducing the amount and size of particulates entrained in the fluids and a flow control device 120 that controls one or more flow parameters or characteristics relating to fluid flow between an annulus 30 and a flow bore 52 of the production string 20 (FIG. 1). Exemplary flow parameters or characteristics include but are not limited to, flow direction, flow rate, pressure differential, degree of laminar flow or turbulent flow, etc. The particulate control device 110 can include a membrane that is fluid permeable but impermeable by particulates. Illustrative devices may include, but are not limited to, a wire wrap, sintered beads, sand screens and associated gravel packs, etc. In one arrangement, a wire mesh 112 may be wrapped around an unperforated base pipe 114.

In embodiments, the flow control device 120 is positioned axially adjacent to the particulate control device 100 and may include a housing 122 configured to receive a flow control element 124. The housing 122 may be formed as tubular member having an annular flow space 126 that is shaped to receive the flow control element 124. The flow space 126 may provide a path for fluid communication between the annulus 30 of the wellbore 10 (FIG. 1) and the flow bore 52 of the production assembly 20. A flow path 132 may direct flow from the particulate control device 110 to the flow control device 120. In one arrangement, the fluid may flow substantially axially through the particulate control device 112, the flow path 132, and the flow control device 120.

Figure 4:
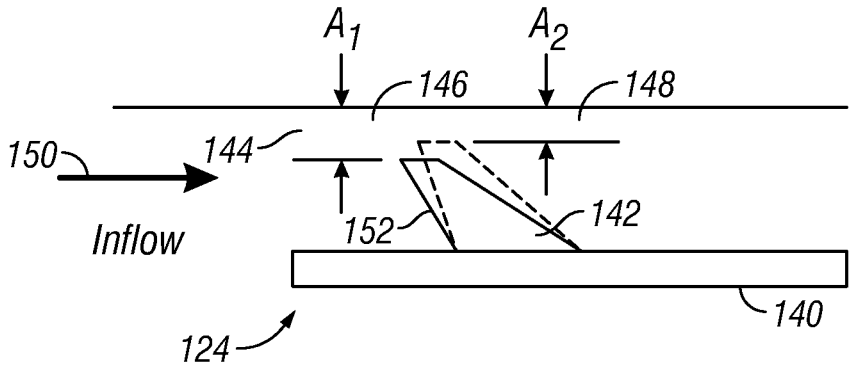
FIG. 4 is a schematic elevation view of exemplary flow control element made in accordance with one embodiment of the present disclosure.

Referring now to FIGS. 3 and 4, in embodiments, the flow control element 124 may be configured to provide a specified local flow rate under one or more given conditions (e.g., flow rate, fluid viscosity, etc.). The flow control element 124 may vary the cross-sectional flow area in the flow space 126 to vary a pressure differential applied the flow control element 124. In one arrangement, an increase in flow rate may increase a pressure differential applied to the flow control element 124. In response, the flow control element 124 may reduce the cross-sectional flow area, which reduces the flow rate. Thus, in a somewhat closed-loop fashion, the flow rate along the flow control device 120 may be limited to a desired range or particular value. Thus, in one aspect, the flow control element 124 may be considered as self-adjusting relative to fluid flow rates.

In one embodiment, the flow control element 124 may be formed as body having a base or sleeve portion 140 and a movable portion 142. The sleeve portion 140 may be shaped to seat on a base pipe 134 or other suitable support structure.

In one arrangement, the movable portion 142 may be an annular rib or fin that projects radially into a gap 144 separating an interior surface of the housing from an exterior surface of the sleeve portion 140. The fin 142 may be formed partially or wholly of a flexible or pliable material that allows the fin 142 to flex between a first diameter and a second larger diameter. This flexure may cause the gap 144 to change in size between a first flow space 146 and a second smaller flow space 148. This change in size causes a corresponding change in the cross-sectional flow area available to the flowing fluid. The fin 142 may be configured to flex in response to a pressure differential caused by a flowing fluid 150. That is, the fin 142 may flex, expand or spread radially outward in response to a change in a pressure applied on the surfaces facing the flowing fluid, i.e., upstream surfaces 152. In some embodiments, the flexure may be graduated or proportionate. For instances, the fin 142 flexes to gradually reduce the gap 144 as the applied pressure differential increases. In other embodiments, the fin 142 may be calibrated to flex after a predetermined threshold pressure differential value has been reached. Also, the fin 142 may be configured to either remain permanently in the radially expanded shape or revert to a radially smaller shape. That is, the fin 142 may exhibit plastic and/or elastic deformation. Any material having an elastic modulus sufficient to allow the fin 142 to flex in response to an applied pressure may be used. Illustrative materials may include, but are not limited to, metals, elastomers and polymers.

Figure 5:
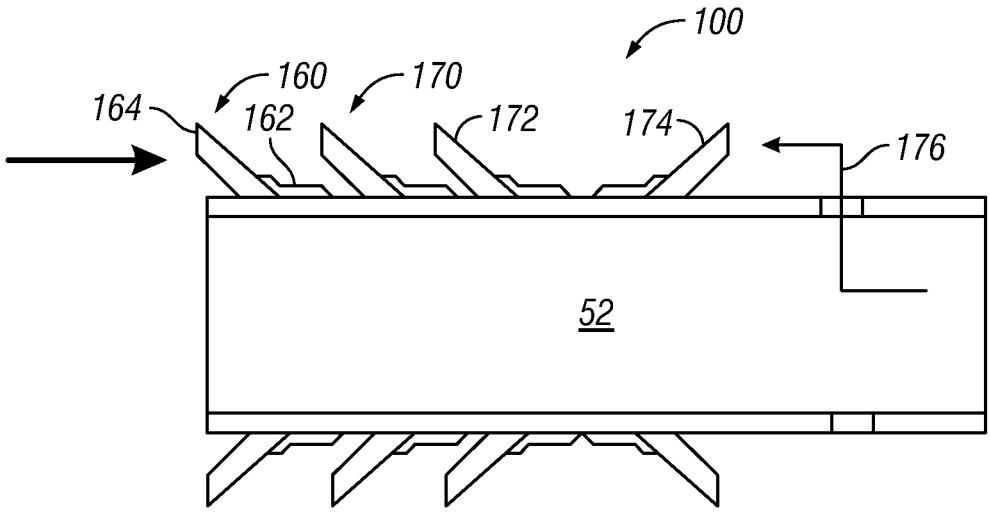
FIG. 5 is a schematic elevation view of other exemplary flow control elements made in accordance with one embodiment of the present disclosure.

It should be understood that the flow control device 120 is susceptible to a variety of configurations. Referring now to FIG. 5, in some embodiments, a flow control element 160 may include a fin 162 coupled to a biasing member 164. The biasing member 164 may be formed of a material capable of applying a biasing force, such as spring steel. The biasing member 164 may be constructed to urge the fin 162 into a radially retracted shape or position. In other embodiments, the biasing member 164 may be embedded in the fin 162. During operation, some or all of the pressure applied to the fin 162 may be transferred to the biasing member 164. As the biasing force is overcome, the fin 162 may move, e.g., pivot or expand to a radially enlarged shape. Also, in embodiments, two or more flow control elements may be serially positioned as shown. Such an arrangement may provide operationally redundancy in that a failure of one flow control element will bring a back-up flow control element into operation. Also, such an arrangement may utilize flow control elements that each are activated or responsive to different pressure differentials. For instance, a flow control 160 may be responsive to a large pressure differential/flow rate, the flow control device 170 is responsive to a medium pressure differential/flow rate, and the flow control device 172 is responsive to a low pressure differential/flow rate.

The teachings of the present disclosure are not limited to only production operations. For instance, referring to FIG. 5, embodiments of the present disclosure may be utilized to regulate injection operations. In injection operations, fluid from the surface or some other location may be pumped via a flow control device 100 into a formation. For such operations, a flow control element 170 may be positioned to be responsive to a fluid 176 flowing from a flow bore 52 into a production control device 100. In an injection mode of operation, a particular section or location in a formation is selected or targeted to be infused or treated with a fluid. The flow control elements 170 may configured as needed to obtain a desired injection pattern, e.g., substantially equalized flow of the injected fluid into the formation over a length of a wellbore.

Referring generally to FIGS. 1-5, in one mode of deployment, the reservoirs 14 and 16 may be characterized via suitable testing and known reservoir engineering techniques to estimate or establish desirable fluid flux or drainage patterns. The desired pattern(s) may be obtained by suitably adjusting the flow control devices 120 to provide a specified flow rate. The desired flow rate may be the same or different for each of the flow control devices 120 positioned along the production assembly 20. Because the pressure may vary for each of the hydrocarbon producing zones, the modulus of elasticity or biasing for each of the flow control elements may be individually varied as needed. That is, the behavior or response of the flow control elements may be tuned to the pressure and/or other parameter relating to a producing zone. Prior to insertion into the wellbore 10, formation evaluation information, such as formation pressure, temperature, fluid composition, wellbore geometry and the like, may be used to estimate a desired flow rate for each flow control device 120. The flow control elements 124 for each device may be selected based on such estimations and underlying analyses.

During a production mode of operation, fluid from the formation 14, 16 flows into the particulate control device 110 and then axially through the passage 132 into the flow control device 120. As the fluid flows through the flow control devices 120, the fluid flowing through the gap 144 of each flow device 120 generates a pressure differential that applies a pressure to the flow control elements 124 of each of the flow control devices 120. Generally speaking, the flow rate of the flowing fluid varies directly with the applied pressures. In response to the applied pressures, which may be the same or different, the flow control elements 124 flex in a predetermined manner to self-regulate in-flow from the production zones. For instance, highly productive zones may have relatively high flow rates that cause the flow control elements 124 to flex to minimize their respective gaps 144. The flow control elements 124 for the less productive zones, however, may exhibit little flexure due to the lower flow rates and therefore maintain their respective gaps 144 in a relatively large size.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control the flow into those and other wellbore tubulars.

In aspects, the present disclosure provides an apparatus for controlling a flow of a fluid between a wellbore tubular and a formation. The apparatus may include a flow control device having a flow space formed therein; and a flow control element positioned in flow space. The flow control element may be configured to flex between a first radial position and a second radial position to in response to a change in a pressure differential along the flow space. In some embodiments, the flow space may be defined a least partially by an inner surface of the flow control device such that a radial flexure of the flow control element varies a space between the inner surface and the flow control element. Also, the flow control element may be configured to reduce a space between the inner surface and the flow control element as fluid flow increases in the space. In some arrangements, the flow control element may include a sleeve element and a movable portion projecting radially outward from the sleeve element. In embodiment, the movable portion is an annular member. Also, the flow control element may be formed at least partially of one of: (i) elastomer, (ii) polymer, and (iii) a metal. In variants, a biasing element may apply a biasing force to the flow control element. For instance, the biasing element may urge the flow control element to a radially retracted shape.

In still further aspects, the present disclosure also provides a system for controlling a flow of a fluid between a wellbore tubular and a formation. The system may include a plurality of flow control devices positioned along the wellbore tubular, wherein each flow control device has a flow space formed therein; and a flow control element positioned in each flow space, each flow control element being configured to flex between a first radial position and a second radial position in response to a change in a pressure differential along the flow space. In some applications, each flow control element is configured to provide a predetermined drainage pattern from the formation. The predetermined drainage pattern may be a substantially even drainage of fluids from at least a portion of the formation. Also, each flow control element may be configured to provide a predetermined fluid injection pattern for the wellbore tubular. In such applications, the fluid injection pattern is a substantially even injection of fluid into at least a portion of the formation.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between a wellbore tubular and a formation, comprising:

a flow control device having a first opening, a second opening, and flow space forming a fluid path between the formation and the wellbore tubular formed therein, the fluid path being between the first opening and the second opening; and a flow control element positioned in the flow space, the flow control element being configured to flex radially outward from a first radial position to a second radial position in response to a change in a pressure differential along the flow space, wherein the fluid flows across the flow space when the flow control element is in the first radial position and the second radial position and wherein an increase in the pressure differential reduces a gap along the flow space, wherein the flow control element is configured to reduce a space between an inner surface of the flow control device and the flow control element as fluid flow increases in the space, and wherein the space remains after the flow control element flexes to a radially outward position, and wherein the flow control element expands radially outward in response to an increase in a pressure applied on a surface facing the flowing fluid.

2. The apparatus according to claim 1 wherein the flow space is defined at least partially by an inner surface of the flow control device, and wherein a radial flexure of the flow control element varies a space between the inner surface and the flow control element, and wherein the flow control element is configured to revert to a radially smaller shape, wherein the flow control element is configured to seat on the wellbore tubular.

3. The apparatus according to claim 1 wherein the flow control element includes a sleeve element and a movable portion projecting radially outward from the sleeve element.

4. The apparatus according to claim 3 further comprising a plurality of movable portions projecting radially outward from the sleeve element.

5. The apparatus according to claim 1, wherein the flow control element is formed at least partially of one of: (i) elastomer, (ii) polymer, and (iii) a metal.

6. The apparatus according to claim 1, further comprising a biasing element applying a biasing force to the flow control element.

7. The apparatus according to claim 6, wherein the biasing element urges the flow control element to a radially retracted shape.

8. A method for controlling a flow of a fluid between a wellbore tubular and a formation using a flow control device, the flow control device including a first opening, an second opening, and a flow space between the first and the second opening, comprising:

controlling fluid flow between the formation and the wellbore tubular in a flow control device along the wellbore tubular by using a flow control element configured to flex radially outward from a first radial position to a second radial position in response to a change in a pressure differential in flow space, wherein the fluid flows along the wellbore tubular when the flow control element is in the first radial position and the second radial position, and wherein an increase in the pressure differential reduces a gap along the flow space, wherein the flow control element diametrically expands when flexing from the first radial position to the second radial position, and wherein the flow control element expands radially outward in response to an increase in a pressure applied on a surface facing the flowing fluid.

9. The method according to claim 8 further comprising seating the flow control element on the wellbore tubular, and varying a size of a flow space in the flow control device using the flow control element.

10. The method according to claim 8 wherein the flow control device includes an annular flow space; and wherein the flow control element is an annular member.

11. The method according to claim 8 wherein the flow control element is formed of an elastically deformable material.

12. The method according to claim 8 further comprising biasing the flow control element to the first radial position.

13. The method according to claim 8, wherein the flow control element is formed at least partially of one of: (i) elastomer, (ii) polymer, and (iii) a metal.

14. A system for controlling a flow of a fluid a wellbore tubular, comprising:

a plurality of flow control devices positioned along the wellbore tubular, wherein each flow control device has a flow space formed therein that allows fluid flow from a first opening in communication with the formation into a second opening in communication with the wellbore tubular; and a flow control element positioned in each flow space, each flow control element having a surface facing a first opening receiving the fluid from the formation, each flow control element being configured to flex radially outward from a first radial position to a second radial position in response to an increase in a pressure applied on the surface facing the fluid flowing from the first opening, wherein the fluid flows across the flow space when the flow control element is in the first radial position and the second radial position, and wherein an increase in the pressure differential reduces a gap along the flow space.

15. The system according to claim 14 wherein each flow control element is configured to provide a predetermined drainage pattern from the formation.

16. The system according to claim 15 the predetermined drainage pattern is a substantially even drainage of fluid from at least a portion of the formation.

17. The system according to claim 14 wherein each flow control element is configured to provide a predetermined fluid injection pattern for the wellbore tubular.

18. The system according to claim 14 wherein the fluid injection pattern is a substantially even injection of fluid into at least a portion of the formation.

* * * * *